US011702326B2

(12) United States Patent
Nunez Duran

(10) Patent No.: US 11,702,326 B2
(45) Date of Patent: Jul. 18, 2023

(54) HOISTING ASSEMBLY

(71) Applicant: Eduardo Nunez Duran, San Jose, CA (US)

(72) Inventor: Eduardo Nunez Duran, San Jose, CA (US)

( * ) Notice: Subject to any disclaimer, the term of this patent is extended or adjusted under 35 U.S.C. 154(b) by 234 days.

(21) Appl. No.: 17/166,654

(22) Filed: Feb. 3, 2021

(65) Prior Publication Data

US 2022/0242705 A1 Aug. 4, 2022

(51) Int. Cl.

*B66D 3/00* (2006.01)
*B66D 3/26* (2006.01)
*B66C 1/12* (2006.01)

(52) U.S. Cl.

CPC ..... *B66D 3/26* (2013.01); *B66C 1/127* (2013.01); *B66D 2700/023* (2013.01)

(58) Field of Classification Search

CPC . B66D 3/26; B66D 3/003; B66D 3/04; B66D 2700/023; B66C 1/127

See application file for complete search history.

(56) References Cited

U.S. PATENT DOCUMENTS 1,319,964 A 10/1919 Morgan
2,496,754 A * 2/1950 Schramm ..... B66D 3/26 254/362
3,165,297 A 1/1965 Thompson, III
4,060,159 A * 11/1977 Chaney ..... B66D 3/26 192/113.36
4,165,863 A * 8/1979 Schreyer ..... B66D 3/26 294/82.16
4,684,031 A 8/1987 Bergman
4,892,203 A * 1/1990 Arav ..... B66D 3/26 212/331
5,265,742 A 11/1993 Stenger
5,772,183 A * 6/1998 Sears ..... B66C 5/025 254/323
D482,174 S 11/2003 Xia
2009/0072560 A1* 3/2009 Tien ..... B66C 1/18 294/74
2011/0110715 A1* 5/2011 Andreasen ..... A61G 7/1042 403/326
2015/0090946 A1* 4/2015 Schwaiger ..... B66D 3/20 254/362

FOREIGN PATENT DOCUMENTS

ES 2498292 T3 * 9/2014 ..... B66D 1/28
JP 5618795 B2 * 11/2014
WO WO2014066705 5/2014

* cited by examiner

*Primary Examiner* — Emmanuel M Marcelo

(57) ABSTRACT

A hoisting assembly for lifting a load into an attic or lowering a load therefrom includes a hoist. The hoist comprises a housing, which has a drum or a lift wheel engaged thereto and positioned in an interior space defined thereby. A suspension module is engaged to and extends from an upper end of the housing. The suspension module can selectively engage a beam so that the housing is suspended from and removably engaged to the beam. A lifting medium is operationally engaged to the drum or the lift wheel and extends from a lower end of the housing. A connector is engaged to the lifting medium distal from the housing. The connector can selectively engage a load so that the load is removably engaged to the lifting medium. The hoist thus is configured to lift the load.

12 Claims, 5 Drawing Sheets

HOISTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to hoisting assemblies and more particularly pertains to a new hoisting assembly for lifting a load into an attic or lowering a load therefrom. The present invention discloses a hoisting assembly comprising a plurality of lines engaged to a hoist, with each line having a coupler engaged thereto for engaging the hoist to a beam. The present invention also discloses a cargo net having closable slits positioned therein, wherein the cargo net can engage a load to the hoist and the slits allow access to or positioning of the load.

(2) Description of Related Art Including Information Disclosed Under 37 CFR 1.97 and 1.98

The prior art relates to hoisting assemblies. Prior art hoisting assemblies may comprise devices for attaching hoists to poles, roof parapets, and roofs. Prior art hoisting assemblies also may comprise strap assemblies for engaging a load to a hoist. What is lacking in the prior art is a hoisting assembly comprising a plurality of lines engaged to a hoist, with each line having a coupler engaged thereto for engaging the hoist to a beam. The prior art also lacks a cargo net having closable slits positioned therein, wherein the cargo net can engage a load to the hoist and the slits allow access to or positioning of the load.

BRIEF SUMMARY OF THE INVENTION

An embodiment of the disclosure meets the needs presented above by generally comprising a hoist. The hoist comprises a housing, which has a drum or a lift wheel engaged thereto and positioned in an interior space defined thereby. A suspension module is engaged to and extends from an upper end of the housing. The suspension module is configured to selectively engage a beam so that the housing is suspended from and removably engaged to the beam. A lifting medium is operationally engaged to the drum or the lift wheel and extends from a lower end of the housing. A connector is engaged to the lifting medium distal from the housing. The connector is configured to selectively engage a load so that the load is removably engaged to the lifting medium. The hoist thus is configured to lift the load.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
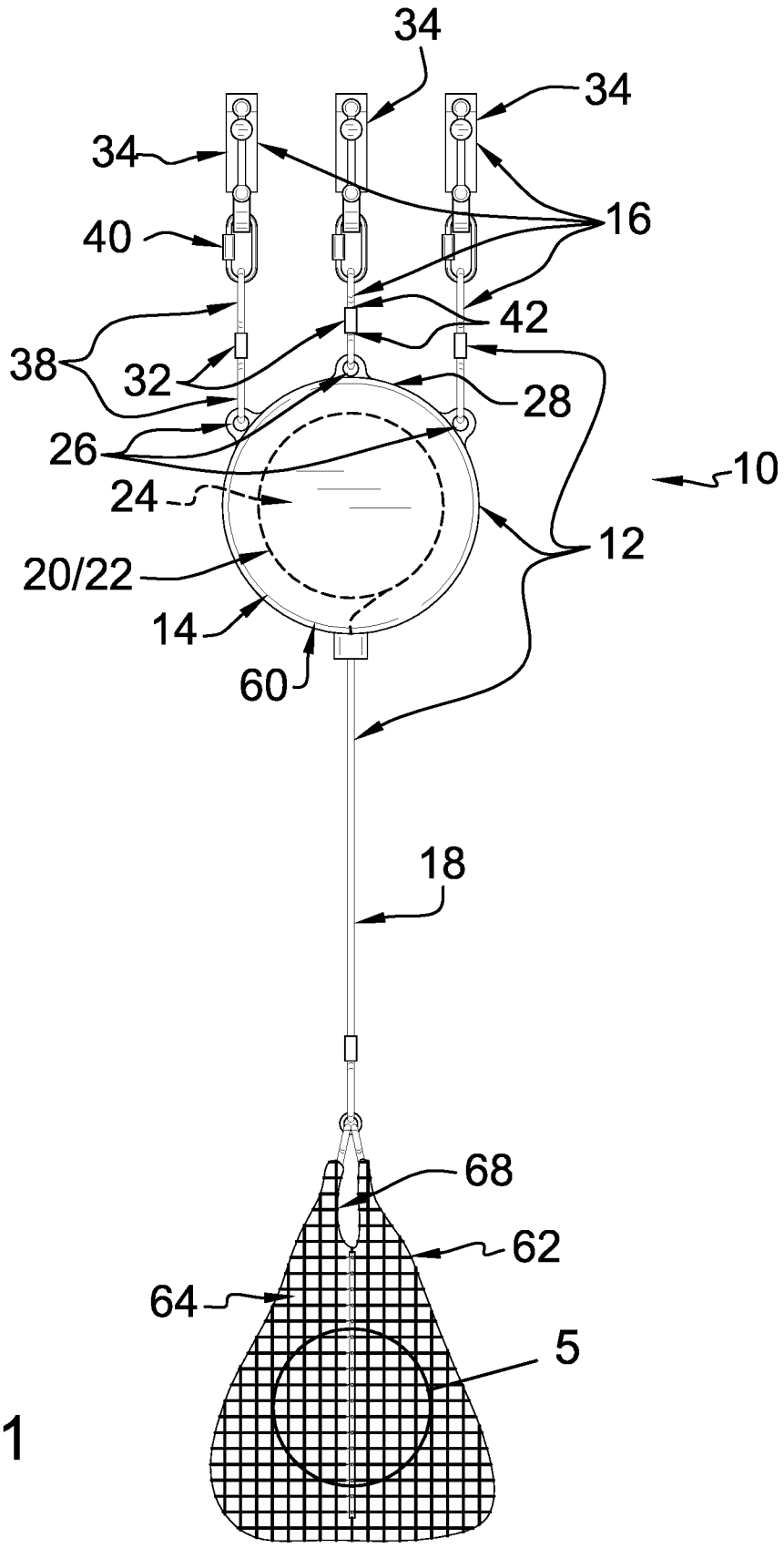
FIG. 1 is a front view of a hoisting assembly according to an embodiment of the disclosure.

With reference now to the drawings, and in particular to FIGS. 1 through 5 thereof, a new hoisting assembly embodying the principles and concepts of an embodiment of the disclosure and generally designated by the reference numeral 10 will be described.

As best illustrated in FIGS. 1 through 5, the hoisting assembly 10 generally comprises a hoist 12. The hoist 12 comprises a housing 14, a suspension module 16, and a lifting medium 18. The hoist 12 is manually, electrically, pneumatically, or hydraulically powered. The housing 14 has a drum 20 or a lift wheel 22 engaged thereto and positioned in an interior space 24 defined thereby. A plurality of first padeyes 26 is engaged to an upper end 28 of the housing 14.

The suspension module 16 is engaged to and extends from the upper end 28 of the housing 14. The suspension module 16 is configured to selectively engage a beam 30 so that the housing 14 is suspended from and removably engaged to the beam 30.

The suspension module 16 comprises a plurality of lines 32, with each line 32 having engaged thereto a coupler 34. The coupler 34 is positioned distal from the hoist 12 and is configured to selectively engage the beam 30 so that the line 32 is removably engaged to the beam 30. The line 32 may comprise a wire rope 36, a pair of cable eyes 38, and a carabiner 40. Each cable eye 38 is engaged to a respective opposed end 42 of the wire rope 36. One of the cable eyes 38 is engaged to a respective first padeye 26 and the carabiner 40 is engaged to the other of the cable eyes 38. The present invention anticipates the plurality of lines 32 comprising other suspending means, such as, but not limited to, rods, plates, ropes, straps, and the like.

The coupler 34 comprises a clamp 44, which is configured to be clamped to the beam 30. The clamp 44 has engaged thereto a second padeye 46. The carabiner 40 is positioned to selectively engage the second padeye 46 to suspend the housing 14 from the coupler 34.

Figure 3:
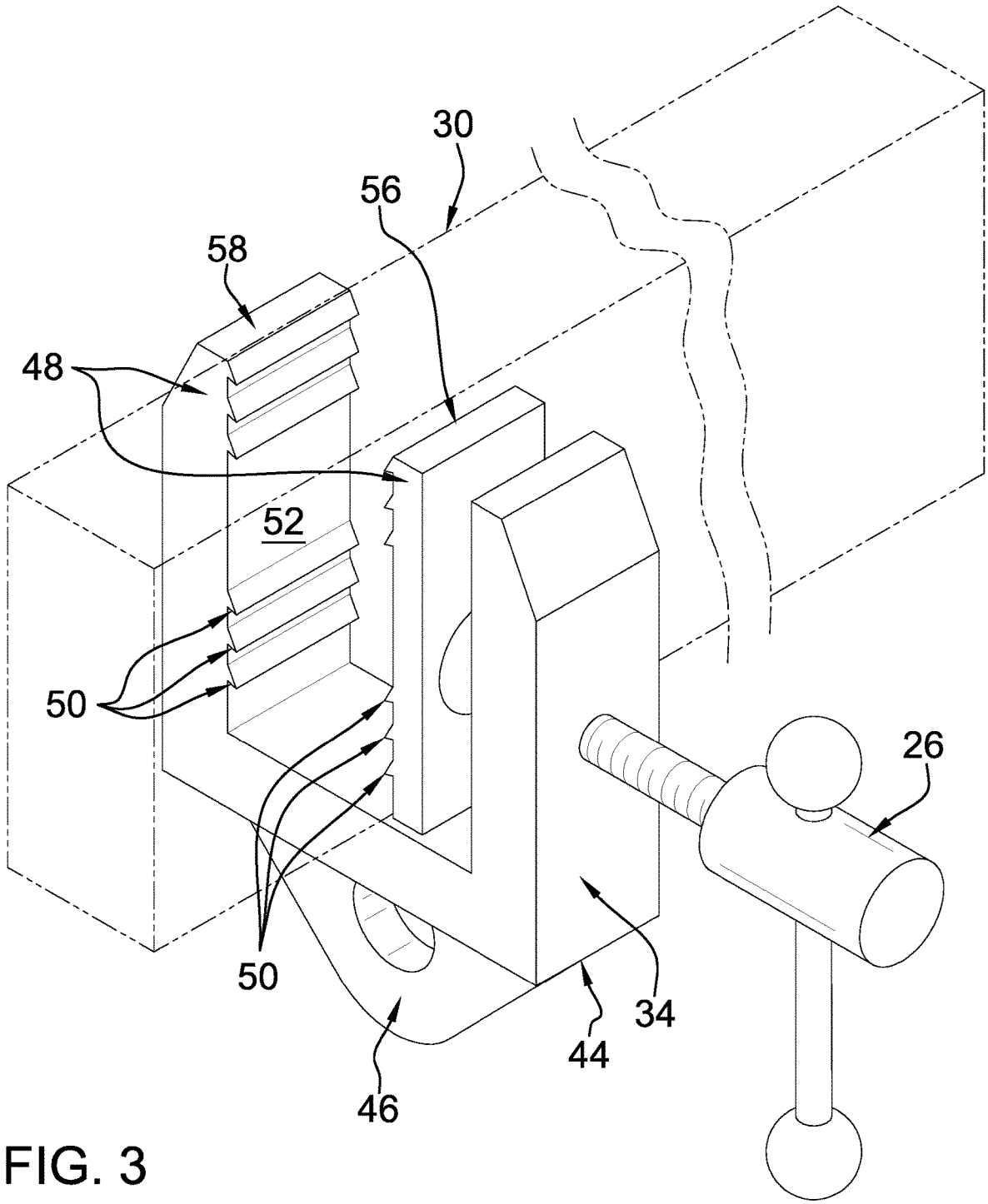
FIG. 3 is a detail view of an embodiment of the disclosure.

The clamp 44 comprises a pair of jaws 48, with each jaw 48 having a plurality of teeth 50 engaged to an inner face 52 thereof, as shown in FIG. 3. The teeth 50 are configured to penetrate into the beam 30 to prevent slippage of the clamp 44. A spindle 54 is engaged to a movable jaw 56 of the pair of jaws 48. The spindle 54 is configured to be grasped in a hand of a user, positioning a user to turn the spindle 54 to motivate the movable jaw 48 toward a fixed jaw 58 of the jaws 48 so that the pair of jaws 48 engages the beam 30.

Figure 2:
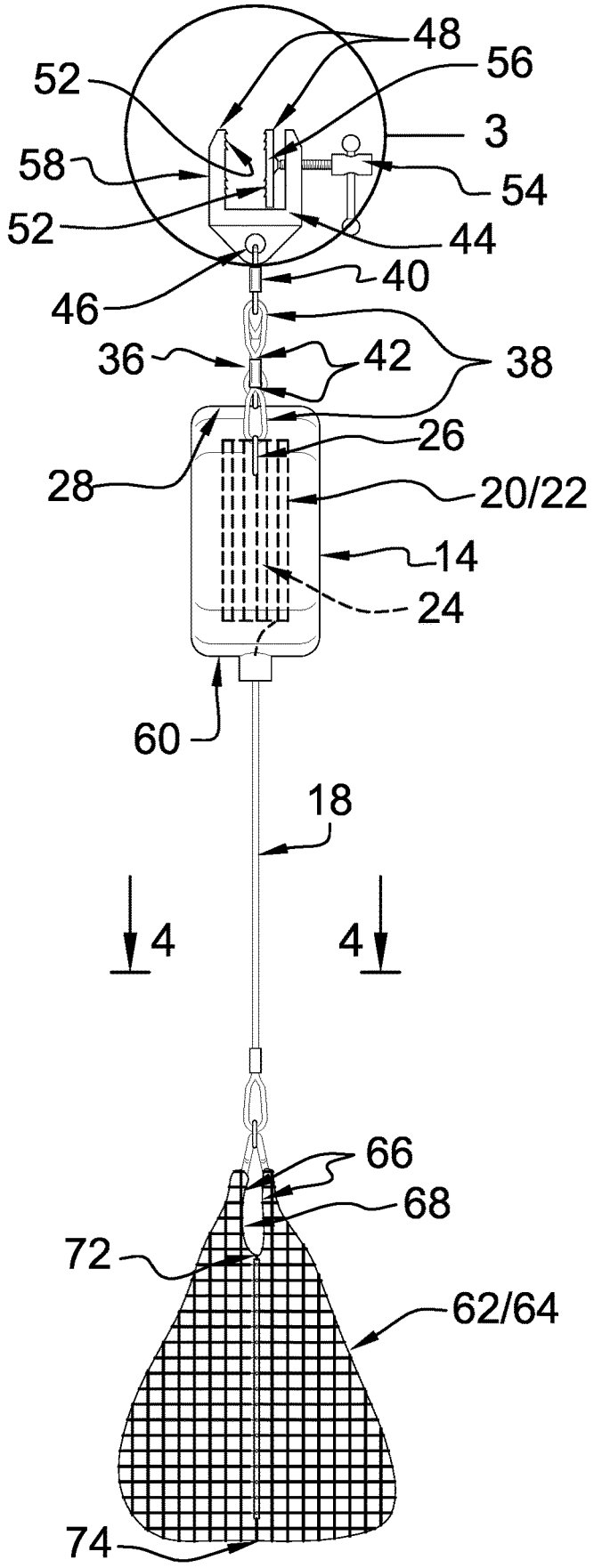
FIG. 2 is a side view of an embodiment of the disclosure.

The lifting medium 18 is operationally engaged to the drum 20 or the lift wheel 22 and extends from a lower end 60 of the housing 14, as shown in FIG. 2. The lifting medium 18 comprises cable, chain, synthetic strap, or rope.

A connector 62 is engaged to the lifting medium 18 distal from the housing 14. The connector 62 is configured to selectively engage a load so that the load is removably engaged to the lifting medium 18. The hoist 12 thus is configured to lift the load.

Figure 4:
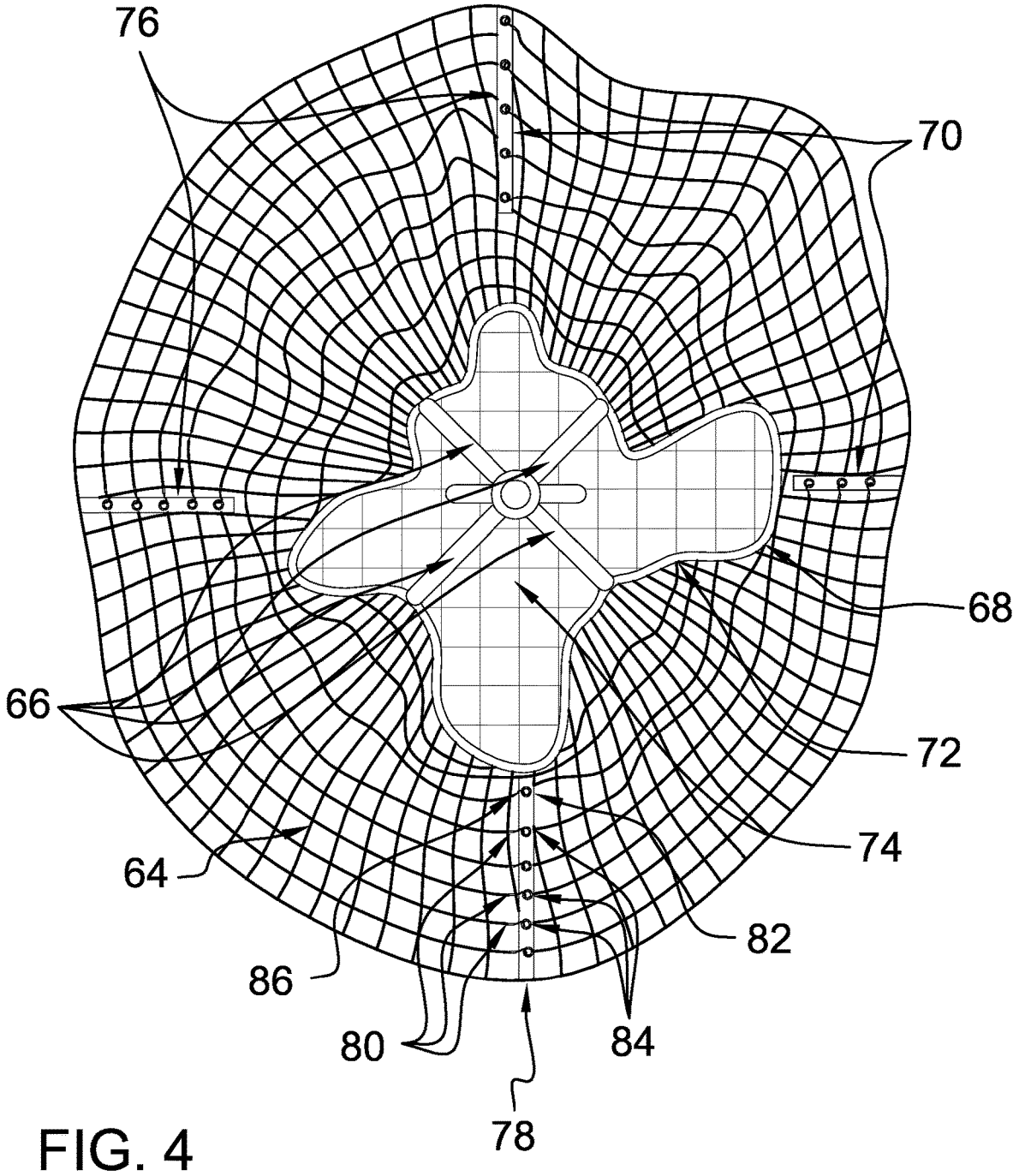
FIG. 4 is a detail view of an embodiment of the disclosure.

The connector 62 may comprise a cargo net 64 and a set of cables 66, as shown in FIG. 4. Each cable 66 is engaged to and extends between a circumference 68 of the cargo net 64 and the lifting medium 18. The cargo net 64 is configured to be positioned around and under the load so that the load is engaged to the lifting medium 18. The set of cables 66 may comprise four cables 66, as shown in FIG. 4, or other number of cables 66, such as, but not limited to, two cables 66, three cables 66, or five or more cables 66. The present invention anticipates the connector 62 comprising other connecting means, such as, but not limited to, hooks, straps, magnets, and the like.

The cargo net 64 has a set of slits 70 positioned therein, with each slit 70 extending from proximate to a top 72 to proximate to a bottom 74 of the cargo net 64. The slit 70 is configured to allow access to or positioning of the load. The set of slits 70 may comprise four slits 70 substantially equally spaced around the circumference 68 of the cargo net 64, as shown in FIG. 4, or other number of slits 70, such as, but not limited to, one slit, two slits 70, or three slits 70.

Figure 5:
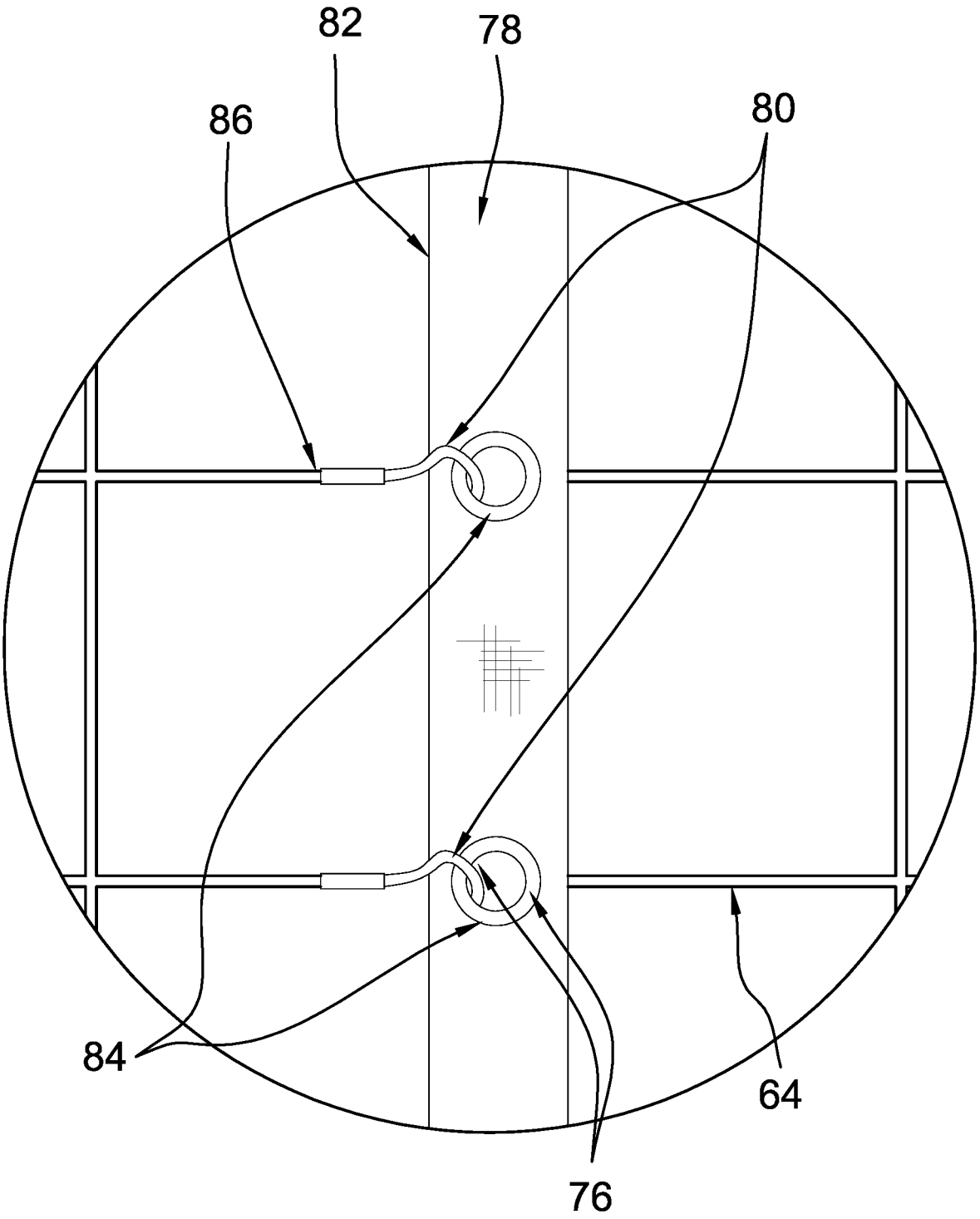
FIG. 5 is a detail view of an embodiment of the disclosure.

Each of a set of closures 76 is engaged to the cargo net 64 and extends along a respective slit 70. The closure 76 is positioned to selectively close the respective slit 70. The closure 76 may comprise a strap 78 and a plurality of hooks 80, as shown in FIG. 5. The strap 78 is engaged to the cargo net 64 and extends along a first side 82 of the respective slit 70. The strap 78 has a plurality of grommets 84 positioned therein. Each hook 80 is engaged to the cargo net 64 and extends from a second side 86 of the respective slit 70. The hook 80 is positioned to selectively engage a respective grommet 84 to close the respective slit 70. The present invention anticipates the closure 76 comprising other closing means, such as, but not limited to, snap closures, zippers, and the like.

In use, the clamps 44 are used to attach the lines 32 to the beam 30, such that the hoist 12 is suspended from the beam 30. For example, the hoist 12 may be suspended from a beam 30 positioned over an access opening of an attic. The hoist 12 is actuated to extend the lifting medium 18 therefrom, such that the connector 62 is positioned to engage the load, such as an HVAC unit, box, or the like. With the load engaged to the connector 62, the hoist 12 can be actuated to lift the load, such as into the attic.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A hoisting device comprising a hoist, the hoist comprising:

a housing defining an interior space, a drum or a lift wheel engaged to the housing and positioned in the interior space, a suspension module engaged to and extending from an upper end of the housing, the suspension module being configured for selectively engaging a beam, such that the housing is suspended from and removably engaged to the beam, a lifting medium operationally engaged to the drum or the lift wheel and extending from a lower end of the housing, a connector engaged to the lifting medium distal from the housing, the connector being configured for selectively engaging a load, such that the load is removably engaged to the lifting medium, wherein the hoist is configured for lifting the load; and wherein the suspension module comprises a plurality of lines, each line having engaged thereto a coupler, the coupler being positioned distal from the hoist, the coupler being configured for selectively engaging the beam, such that the line is removably engaged to the beam.

2. The hoisting assembly of claim 1, wherein the hoist is manually, electrically, pneumatically, or hydraulically powered.

3. The hoisting assembly of claim 1, further including:

a plurality of first padeyes engaged to the upper end of the housing, the line comprising:

a wire rope, a pair of cable eyes, each cable eye being engaged to a respective opposed end of the wire rope, one of the cable eyes being engaged to a respective first padeye, and a carabiner engaged to the other of the cable eyes; and the coupler comprising a damp, wherein the clamp is configured for clamping to the beam, the clamp having engaged thereto a second padeye, such that the carabiner is positioned for selectively engaging the second padeye for suspending the housing from the coupler.

4. The hoisting assembly of claim 3, wherein the clamp comprises a pair of jaws, each jaw having a plurality of teeth engaged to an inner face thereof, such that the teeth are configured for penetrating into the beam for preventing slippage of the clamp.

5. The hoisting assembly of claim 4, further including a spindle engaged to a movable jaw of the pair of jaws, wherein the spindle is configured for grasping in a hand of a user, positioning a user for turning the spindle for motivating the movable jaw toward a fixed jaw of the jaws, such that the pair of jaws engages the beam.

6. The hoisting assembly of claim 1, wherein the lifting medium comprises cable, chain, synthetic strap, or rope.

7. A hoisting device comprising a hoist, the hoist comprising:

a housing defining an interior space, a drum or a lift wheel engaged to the housing and positioned in the interior space, a suspension module engaged to and extending from an upper end of the housing, the suspension module being configured for selectively engaging a beam, such that the housing is suspended from and removably engaged to the beam, a lifting medium operationally engaged to the drum or the lift wheel and extending from a lower end of the housing, a connector engaged to the lifting medium distal from the housing, the connector being configured for selectively engaging a load, such that the load is removably engaged to the lifting medium, wherein the hoist is configured for lifting the load; and wherein the connector comprises a cargo net and a set of cables, each cable being engaged to and extending between a circumference of the cargo net and the lifting medium, wherein the cargo net is configured for positioning around and under the load, such that the load is engaged to the lifting medium.

8. The hoisting assembly of claim 7, wherein the set of cables comprises four cables.

9. The hoisting assembly of claim 7, further including:

the cargo net having a set of slits positioned therein, each slit extending from proximate to a top to proximate to a bottom of the cargo net, wherein the slit is configured for accessing or positioning the load; and a set of closures, each closure being engaged to the cargo net and extending along a respective slit, such that the closure is positioned for selectively closing the respective slit.

10. The hoisting assembly of claim 9, wherein the set of slits comprises four slits substantially equally spaced around the circumference of the cargo net.

11. The hoisting assembly of claim 9, wherein the closure comprises:

a strap engaged to the cargo net and extending along a first side of the respective slit, the strap having a plurality of grommets positioned therein; and a plurality of hooks, each hook being engaged to the cargo net and extending from a second side of the respective slit, such that the hook is positioned for selectively engaging a respective grommet for closing the respective slit.

12. A hoisting assembly comprising:

a hoist, the hoist being manually, electrically, pneumatically, or hydraulically powered, the hoist comprising:

a housing defining an interior space, a plurality of first padeyes engaged to an upper end of the housing, a drum or a lift wheel engaged to the housing and positioned in the interior space, a suspension module engaged to and extending from the upper end of the housing, the suspension module being configured for selectively engaging a beam, such that the housing is suspended from and removably engaged to the beam, the suspension module comprising a plurality of lines, each line having engaged thereto a coupler, the coupler being positioned distal from the hoist, the coupler being configured for selectively engaging the beam, such that the line is removably engaged to the beam, the line comprising:

a wire rope, a pair of cable eyes, each cable eye being engaged to a respective opposed end of the wire rope, one of the cable eyes being engaged to a respective first padeye, and a carabiner engaged to the other of the cable eyes, the coupler comprising a clamp, wherein the clamp is configured for clamping to the beam, the clamp having engaged thereto a second padeye, such that the carabiner is positioned for selectively engaging the second padeye for suspending the housing from the coupler, the clamp comprising a pair of jaws, each jaw having a plurality of teeth engaged to an inner face thereof, such that the teeth are configured for penetrating into the beam for preventing slippage of the clamp, a spindle engaged to a movable jaw of the pair of jaws, wherein the spindle is configured for grasping in a hand of a user, positioning a user for turning the spindle for motivating the movable jaw toward a fixed jaw of the jaws, such that the pair of jaws engages the beam, a lifting medium operationally engaged to the drum or the lift wheel and extending from a lower end of the housing, the lifting medium comprising cable, chain, synthetic strap, or rope, and a connector engaged to the lifting medium distal from the housing, the connector being configured for selectively engaging a load, such that the load is removably engaged to the lifting medium, wherein the hoist is configured for lifting the load;

the connector comprising a cargo net and a set of cables, each cable being engaged to and extending between a circumference of the cargo net and the lifting medium, wherein the cargo net is configured for positioning around and under the load, such that the load is engaged to the lifting medium, the set of cables comprising four cables, the cargo net having a set of slits positioned therein, each slit extending from proximate to a top to proximate to a bottom of the cargo net, wherein the slit is configured for accessing or positioning the load, the set of slits comprising four slits substantially equally spaced around the circumference of the cargo net; and a set of closures, each closure being engaged to the cargo net and extending along a respective slit, such that the closure is positioned for selectively closing the respective slit, the closure comprising:

a strap engaged to the cargo net and extending along a first side of the respective slit, the strap having a plurality of grommets positioned therein, and a plurality of hooks, each hook being engaged to the cargo net and extending from a second side of the respective slit, such that the hook is positioned for selectively engaging a respective grommet for closing the respective slit.

* * * * *